United States Patent [19]

Saito et al.

[11] Patent Number: 4,633,840

[45] Date of Patent: Jan. 6, 1987

[54] METHOD FOR CONTROLLING AIR-FUEL RATIO IN INTERNAL COMBUSTION ENGINE

[75] Inventors: Tsutomu Saito, Okazaki; Tsuneyuki Egami, Aichi; Tokio Kohama, Nishio; Kimitaka Saito, Okazaki; Hiroshi Takahashi, Toyota; Kunihiko Sato, Okazaki, all of Japan

[73] Assignees: Nippon Soken, Inc., Nishio; Toyota Jidosha Kabushiki Kaisha, Toyota, both of Japan

[21] Appl. No.: 690,502

[22] Filed: Jan. 10, 1985

[30] Foreign Application Priority Data

Jan. 14, 1984 [JP] Japan ..... 59-004254
Jan. 26, 1984 [JP] Japan ..... 59-010937
Jan. 28, 1984 [JP] Japan ..... 59-012859

[51] Int. Cl.[4] ..... F02D 41/14

[52] U.S. Cl. ..... 123/489; 123/492; 123/493

[58] Field of Search ..... 123/489, 492, 493

[56] References Cited

U.S. PATENT DOCUMENTS 4,235,204 11/1980 Rice ..... 123/440
4,245,605 1/1981 Rice et al. ..... 123/492
4,270,503 6/1981 Pomerantz ..... 123/438
4,356,803 11/1982 Miyagi ..... 123/492
4,416,237 11/1983 Aoki et al. ..... 123/438
4,437,446 3/1984 Isomura et al. ..... 123/492
4,467,769 8/1984 Matsumura ..... 123/489
4,499,882 2/1985 Saito et al. ..... 123/492

FOREIGN PATENT DOCUMENTS 58-133434 8/1983 Japan .
58-133435 8/1983 Japan .

*Primary Examiner*—Andrew M. Dolinar
*Attorney, Agent, or Firm*—Cushman, Darby & Cushman

[57] ABSTRACT

Air-fuel ratio control of an internal combustion engine is performed using sensors for detecting operating conditions of the engine, such as the intake air amount, engine rotational speed, or air-fuel ratio; a fuel injection valve driven by an electrical signal to inject fuel; and a control circuit for receiving signals from the operating condition sensors, performing predetermined operations and generating an electrical signal for driving the fuel injection valve. The control circuit performs a step of calculating an air-fuel ratio variation D(A/F) with respect to an optimum air-fuel ratio based on the ratio of a change ΔF, of an air-fuel ratio correction signal F during acceleration under air-fuel ratio feedback control based on a signal from the air-fuel ratio sensor, to an acceleration amount A, and a step of controlling a transient fuel correction ratio f(AEW) based on the obtained air-fuel ratio variation D(A/F).

18 Claims, 39 Drawing Figures

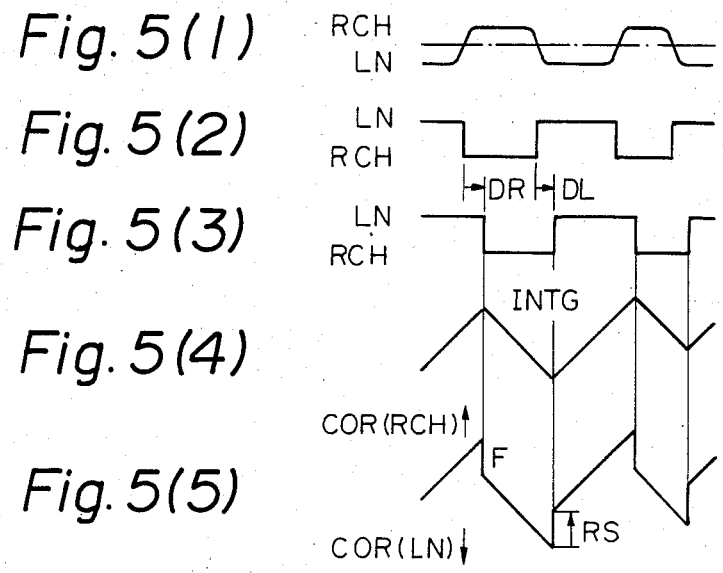
Fig. 5(1)
RCH
LN
Fig. 5(2)
LN
RCH
DR
DL
Fig. 5(3)
LN
RCH
INTG
Fig. 5(4)
COR(RCH)
F
Fig. 5(5)
RS
COR(LN)
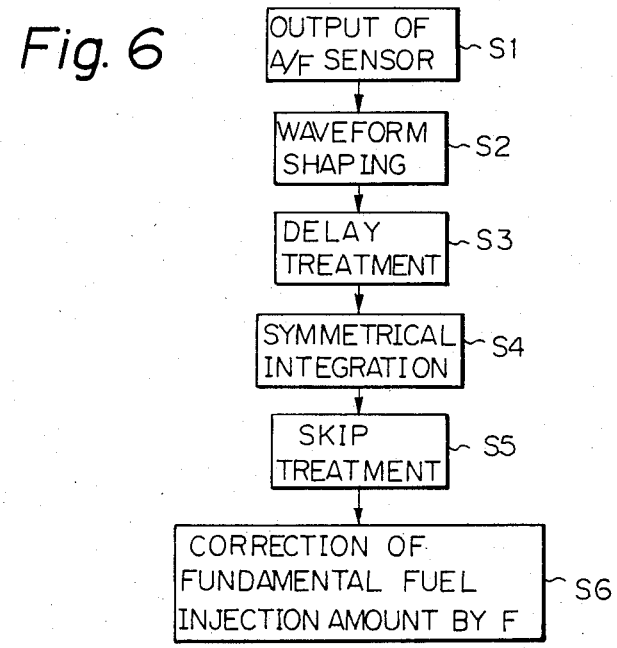
Fig. 6
OUTPUT OF A/F SENSOR
S1
WAVEFORM SHAPING
S2
DELAY TREATMENT
S3
SYMMETRICAL INTEGRATION
S4
SKIP TREATMENT
S5
CORRECTION OF FUNDAMENTAL FUEL INJECTION AMOUNT BY F
S6

S600
START
S601
32.7ms ELAPSED ?
NO
YES
S602
WATER TEMP. < 80°C ?
NO
YES
S602A
PREDETERMINED VALUE OR MORE ACCELERATION ?
NO
YES
S603
5 SECOND ELAPSED AFTER ACCELERATION ?
NO
YES
S604
900rpm≦N≦2000rpm
NO
YES
S605
IF FEEDBACK CONTROL ?
NO
YES
S606
O2 SENSOR RICH OR LEAN ?
RCH
LN

METHOD FOR CONTROLLING AIR-FUEL RATIO IN INTERNAL COMBUSTION ENGINE

BACKGROUND OF THE INVENTION

1. Field of the Invention

The present invention relates to a method for controlling the air-fuel ratio in an internal combustion engine, more particularly to such a method utilized in an automobile engine having an electronically controlled fuel injection device.

2. Description of the Related Art

In one known type of apparatus for controlling the air-fuel ratio of an internal combustion engine, there is provided a means for generating a fundamental fuel injection signal representing the amount of fuel to be injected to the engine in a normal state based on predetermined operational parameters of the engine, e.g., engine temperature; means for detecting a transient operating condition of the engine; means, responsive to the measured engine temperature and the detected transient operating condition of the engine, for generating a correction promotion signal which has an initial value equal to a first value determined by the engine temperature and determined by the detected transient condition of the engine and which is increased by a factor which changes to unity (1), at a speed determined by the engine temperature; and means for supplying fuel to the engine based on the fundamental fuel injection signal and the correction signal, thereby supplying fuel to the engine in either the normal state or the transient state of the engine. This apparatus provides a fuel supply system which allows optimum operation of the engine by constant maintenance of the optimum air-fuel ratio in either the normal state or the transient state of the engine (e.g., Japanese Unexamined Patent Publication (Kokai), No. 56-6034.)

In the apparatus of the type described above, however, no consideration is given to changes in characteristics caused by changes in engine performance over time, e.g., buildup of deposits at a valve clearance or at an injector nozzle in an electronic fuel injection (EFI) system, buildup of deposits (deposits of fine carbon particles from lubricant components or fuel combustion products) at the rear surface of a cylinder intake valve or the like, or changes in the volatility of gasoline due to variations in the properties of the gasoline. The apparatus described above does not have means for compensating for deviations or variations from an optimum value of the air-fuel ratio during acceleration due to changes in characteristics of the engine or changes in the properties of gasoline. If gasoline of a low volatility is used or the operating characteristics of the engine change with time, the drivability of the engine is apt to be deteriorated causing uneven acceleration due to a lean fuel mixture during acceleration. Conversely, when gasoline of a high volatility is used, the air-fuel ratio becomes rich, resulting in a decrease in mileage or poor emission.

In the normal state, clogging of an injector can be corrected by feedback of an output from an air-fuel sensor. However, since no correction means is incorporated in consideration of acceleration, similar problems are encountered. Furthermore, similar problems are also encountered due to variations in the manufacture of engines and air-flow meters or changes over time thereof.

SUMMARY OF THE INVENTION

It is an object of the present invention to provide a method for controlling the air-fuel ratio in an internal combustion engine, which is free from the problems occurring with conventional methods and which reduces deviations or variations in the air-fuel ratio from an optimal air-fuel ratio of an air-fuel mixture during acceleration or deceleration, such deviation or variation being caused by buildup of a deposit on the back surface of an intake valve, clogging of an injector, or changes in an engine or intake air amount detecting device over time or by differences in the properties of gasoline, variations in the manufacture of an engine, or variations in the manufacture of an air-flow meter, so that degradation or decrease in the emission or mileage is prevented, the performance is improved, and the deviation of the air-fuel ratio from the optimum air-fuel ratio can be reduced with high reliability.

According to the fundamental aspect of the present invention, there is provided a method for controlling the air-fuel ratio in an internal combustion engine using an operating condition sensing unit for sensing the intake air amount, the engine rotational speed, the air-fuel ratio, and the like of the engine, an injection valve unit driven by an electrical signal to carry out injection of fuel, and a control unit for receiving signals from the operating condition sensing unit and producing the electrical signals for driving the injection valve unit. In this method, a process for obtaining an air-fuel ratio variation (D(A/F)) with respect to an optimum air-fuel ratio on the basis of a ratio between a variation amount ($\Delta$F) of an air-fuel ratio correction signal (F) and an acceleration amount in air-fuel ratio feed-back control using the air-fuel ratio sensing unit and the subsequent process for regulating a transient fuel amount correction ratio (f(AEW)) on the basis of the obtained air-fuel ratio variation (D(A/F)) are carried out in the control unit.

According to another aspect of the present invention, there is provided a method for controlling the air-fuel ratio in an internal combustion engine using an operating condition sensing unit for sensing the intake air amount, the engine rotational speed, the air-fuel ratio, and the like of the engine, an injection valve unit driven by an electrical signal to carry out injection of fuel, and a control unit for receiving signals from the operating condition sensing unit and producing the electrical signal for driving the injection valve unit. In this method, a process for prohibiting regulation of the correction amount in transient fuel amount correction when no correct detection of air-fuel ratio variation is achieved because of a disturbance in the engine condition, a process of obtaining a value corresponding to an air-fuel ratio variation with respect to an optimum air-fuel ratio in the engine where no disturbing influence is exerted on the engine condition, and a process for regulating a correction amount of the transient fuel amount correction on the basis of the obtained value corresponding to the air-fuel ratio are carried out in the control unit.

According to still another aspect of the present invention, there is provided a method for controlling the air-fuel ratio in an internal combustion engine using an operating condition sensing unit for sensing the intake air amount, the engine rotational speed, the air-fuel ratio, and the like of the engine, an injection valve unit driven by an electrical signal to carry out injection of fuel, and a control unit for receiving signals from the operating condition sensing unit and producing the electrical signal for driving the injection valve unit. In this method, a process for detecting an air-fuel ratio variation with respect to an optimum air-fuel ratio as a valid air-fuel ratio variation when an acceleration/deceleration amount of the engine exceeds a predetermined threshold value, while detecting an air-fuel ratio variation with respect to the optimum air-fuel ratio as an invalid air-fuel ratio variation when the acceleration/deceleration amount of the engine is below the predetermined threshold value, and a process for regulating the correction amount of the transient fuel amount correction on the basis of the air-fuel ratio variation detected as a valid air-fuel ratio are carried out in the control unit.

BRIEF DESCRIPTION OF THE DRAWINGS

FIGS. 5(1)–5(5) and 6 are a waveform chart and a flow chart, respectively, for explaining the air-fuel ratio control;

DESCRIPTION OF THE PREFERRED EMBODIMENTS

Figure 1:
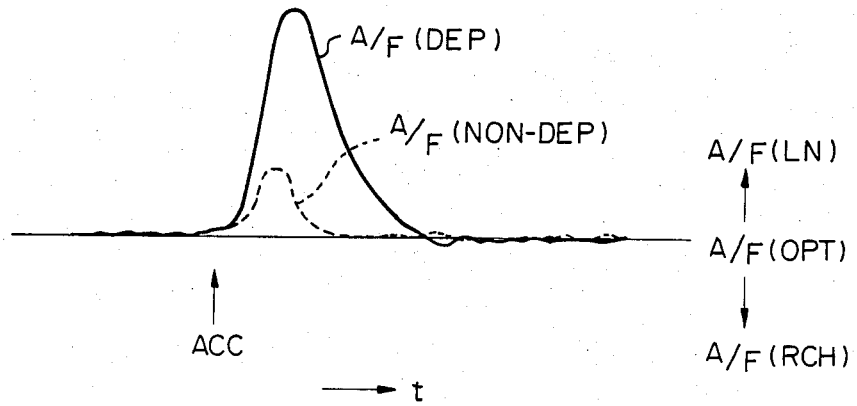
FIG. 1 is a graph of changes in the air-fuel ratio over time when a deposit buildup occurs on the rear surface of an intake valve.

In order to facilitate understanding of the embodiments of the present invention, FIG. 1 shows changes in the air-fuel ratio, more specifically, the changes in the air-fuel ratio when a deposit builds up on the rear surface of an air intake valve. Referring to FIG. 1, solid curve A/F(NON-DEP) shows the air-fuel ratio before a deposit is attached, and dotted curve A/F(DEP) shows the air-fuel ratio after the deposit is attached. Note that, in FIG. 1, ACC denotes an acceleration point, A/F(OPT) denotes the optimum air-fuel ratio, A/F(LN) denotes a lean air-fuel mixture, and A/F-(RICH) denotes a rich air-fuel mixture.

Figure 2:
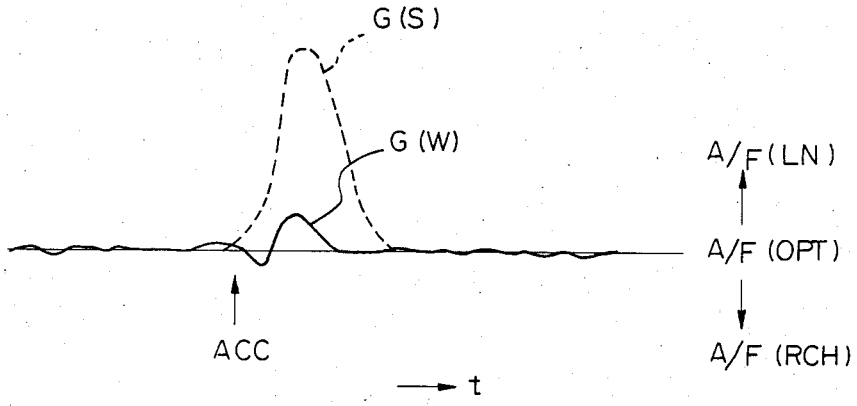
FIG. 2 is a graph of changes in the air-fuel ratio over time when gasoline properties are different.

FIG. 2 shows changes in the air-fuel ratio when the properties of gasoline are different. In this case, a similar problem presented upon buildup of a deposit as in FIG. 1 is encountered. In general, a single petroleum company sells gasoline of different properties during four seasons, for example, one type for summer and another for winter. The lead vapor pressure or distillation property is generally used as an index of the volatility of gasoline. However, when gasoline available from a selected petroleum company was examined over four seasons, the lead vapor pressure was found to vary within the range of 0.5 $kg/cm^2$ and 0.86 $kg/cm^2$ and the 10% distillation temperature to vary between 40° C. and 50° C. The air-fuel ratio changes are shown in FIG. 2 with changes in gasoline volatility due to differences in properties of gasoline. Referring to FIG. 2, curve G(S) corresponds to gasoline for summer use, and curve G(W) corresponds to gasoline for winter use. In the example shown in FIG. 2, the air-fuel ratio changes to the lean side. However, the air-fuel ratio may change to the rich side depending upon circumstances.

Figure 3:
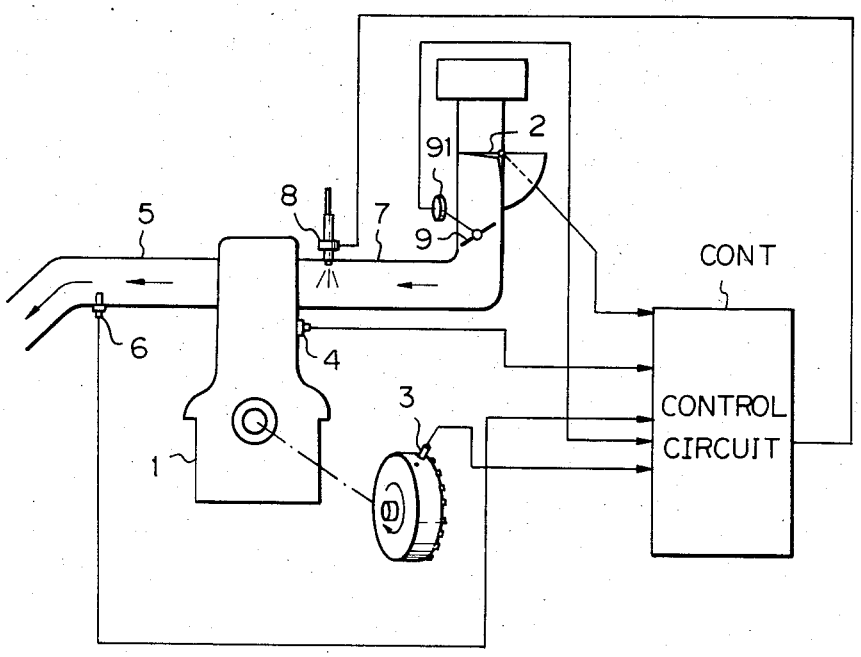
FIG. 3 is a circuit diagram of an apparatus for performing a method for controlling the air-fuel ratio in an internal combustion engine according to an embodiment of a fundamental aspect of the present invention.

An apparatus for controlling the air-fuel ratio in an internal combustion engine according to the method of an embodiment of the present invention is illustrated in FIG. 3.

In the apparatus shown in FIG. 3, reference numeral 1 denotes a six-cylinder spark-ignition engine of a known electronically controlled fuel injection type as a power source of an automobile; 2, a known intake air amount sensor for detecting the air intake amount; 3, a rotational speed sensor for detecting the rotational speed of the engine 1; 4, a known water temperature sensor for measuring the cooling water temperature of the engine 1; 5, an exhaust gas path of the engine 1; and 6, a known air-fuel ratio sensor inserted in the exhaust gas path 5. Also, referring to FIG. 3, reference numeral 7 denotes an intake pipe of the engine 1; 8, a known solenoid fuel injection valve inserted in the intake pipe 7; 9, a throttle valve for controlling the amount of air taken into the engine 1; and 91, a known throttle sensor for detecting the movement of the throttle valve 9. Reference symbol CONT denotes a control circuit for calculating a fuel amount to be supplied to the engine 1 and for actuating the fuel injection valve 8.

When the engine 1 is in a normal state, the control circuit CONT calculates the amount of fuel supplied to the engine 1 as a fundamental fuel injection amount in accordance with detection signals from the intake air amount sensor 2, the rotational speed sensor 3, and the water temperature sensor 4. The control circuit CONT corrects a feedback correction amount as an open time of the fuel injection valve 8 in accordance with a signal from the A/F sensor 6.

When an acceleration state of the engine 1 is detected by the throttle sensor 91 or the intake air amount sensor 2, the control circuit CONT increases the fuel injection amount for the duration of the acceleration as compared to the fuel injection amount in the normal state.

Figure 4:
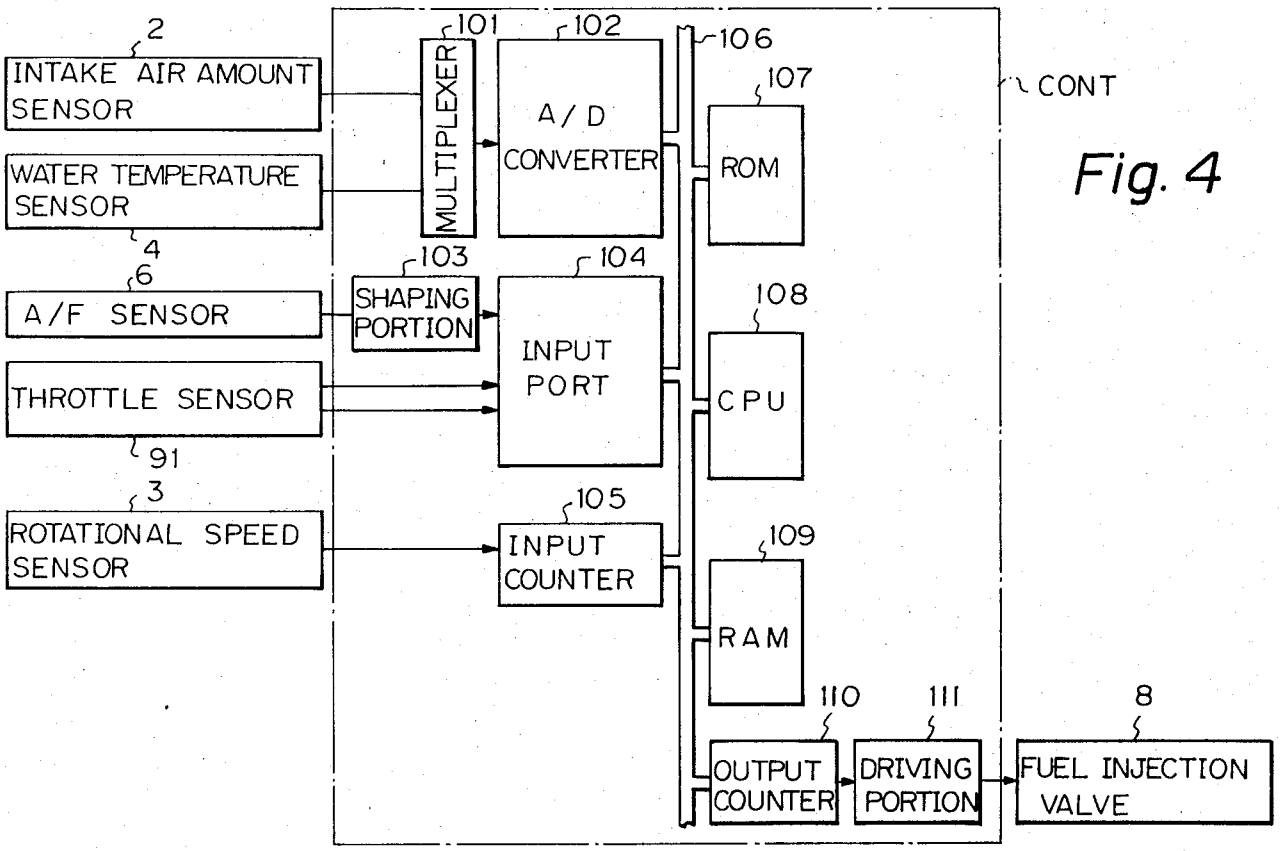
FIG. 4 is a block diagram of a control circuit in the apparatus shown in FIG. 3.

FIG. 4 shows the configuration of the control circuit CONT in the apparatus shown in FIG. 3. The control circuit CONT has, as an input system, a multiplexer 101 for receiving signals from the intake air amount sensor 2 and the water temperature sensor 4, an analog-to-digital (A/D) converter 102, a shaping portion 103 for receiving the signal from the A/F sensor 6, an input port 104 for receiving signals from the shaping portion 103 and the throttle sensor 91, and an input counter 105 for receiving a signal from the rotational speed sensor 3.

The control circuit CONT also has a bus 106, a read only memory (ROM) 107, a central processing unit (CPU) 108, a random access memory (RAM) 109, an output counter 110, and a driving portion 111. An output signal from the driving portion 111 is supplied to the fuel injection valve 8.

In an internal combustion engine, an $O_2$ sensor is used as an air/fuel ratio variation detecting means, and the air-fuel ratio of the engine is controlled to coincide with an optimum air-fuel ratio. The control sequence for achieving this is illustrated in FIGS. 5 and 6. FIG. 5 shows (1) an air-fuel ratio sensor output signal, (2) a shaped signal, (3) a delayed signal, (4) a symmetrically integrated signal, and (5) a signal after skip treatment or processing. Referring to FIG. 5, reference symbol RCH denotes rich; LN, lean; DR and DL, delay; INTG, an integration signal; F, an air-fuel ratio correction signal; COR(RCH), rich correction; COR(LN), lean correction; and RS, a skip amount. FIG. 6 shows steps of the A/F sensor signal output (S1), shaping (S2), delay treatment or processing (S3), symmetrical integration (S4), skip treatment or processing (S5), and correction of the fundamental fuel injection amount by an air/fuel ratio correction signal F (S6). Steps S1 to S6 in FIG. 6 correspond to the waveforms (1) to (5) in FIG. 5.

Figure 7:
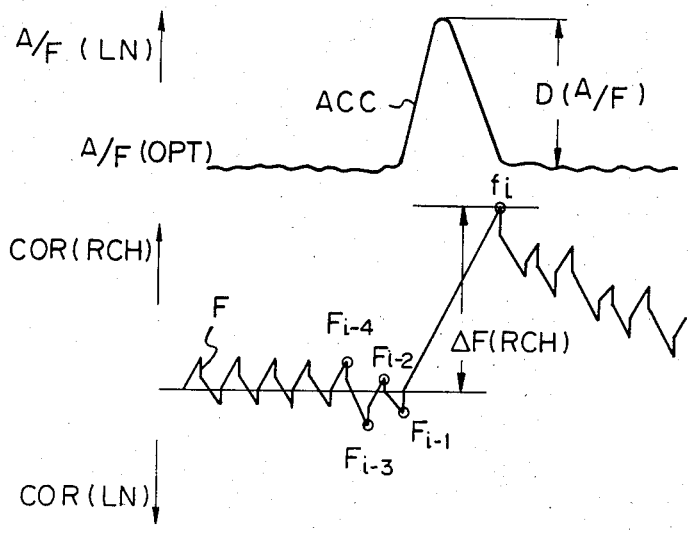
FIG. 7 is a waveform chart for showing a signal from an $O_2$ sensor and the air-fuel ratio behavior.

FIG. 7 shows the control signal waveform of the $O_2$ sensor and the behavior of the air-fuel ratio when the air-fuel ratio varies toward the lean side in a transient state. As shown in FIG. 7, in a transient state, a deviation or variation in the air-fuel ratio from the optimum air-fuel ratio can be detected in accordance with the air-fuel ratio correction signal F. However, in practice, a vehicle is rarely operated in a normal state and is more frequently operated in a transient state (acceleration/deceleration). Therefore, in order to correctly detect the variation in the air-fuel ratio in a transient state using the signal F, the variation in the air-fuel ratio in the transient state and the normal state wherein the signal F is stable must be detected using the signal F, and the acceleration amount or deceleration amount must then be corrected in accordance with the calculated variation. In FIG. 7, ΔF(RCH) denotes the range of variation in the air-fuel ratio correction signal to the rich side.

Figure 8:
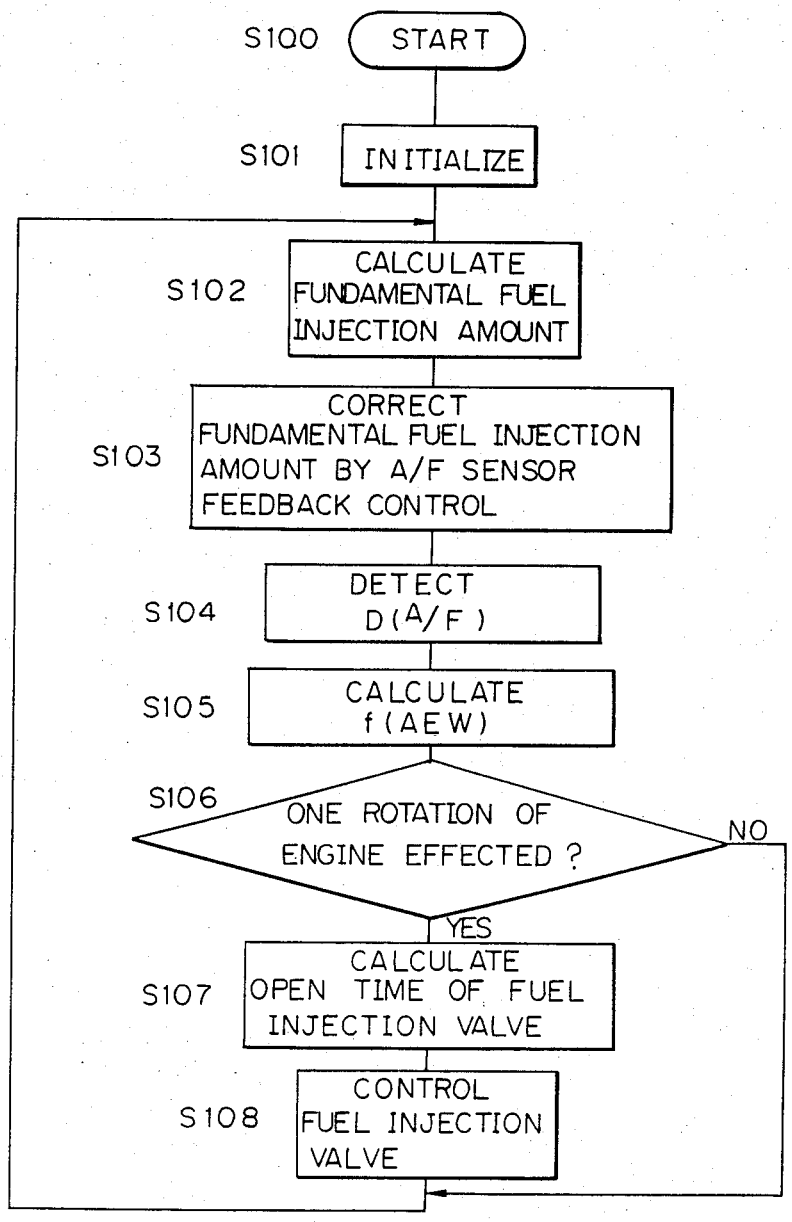
FIG. 8 is a flow chart of a control sequence of the control circuit.

FIG. 8 is a schematic flow chart of a control program of the control circuit CONT. This program is for performing electronically controlled fuel injection. In step S100, the flow starts. In step S101, the initialization of the memories and input/output ports is performed. In step S102, a fundamental fuel injection amount is calculated in accordance with intake air amount data Q, engine rotational speed data N, and water temperature sensor data $\theta_W$.

In step S103, the signal from the A/F sensor 6 is used to perform feedback control and to keep the air-fuel ratio constant, thereby correcting the fundamental fuel injection amount. In steps S104 and S105, the transient state air-fuel ratio variation (D(A/F)) and the transient fuel amount correction ratio (f(AEW)) are calculated.

In step S106, it is checked if one rotation of the engine is effected. In step S107, the open time of the fuel injection valve 8 per rotation of the engine 1 is calculated in accordance with the fundamental fuel injection amount and the transient fuel amount correction ratio which are corrected by feedback control. In step S108, the fuel injection valve is controlled.

Figure 9:
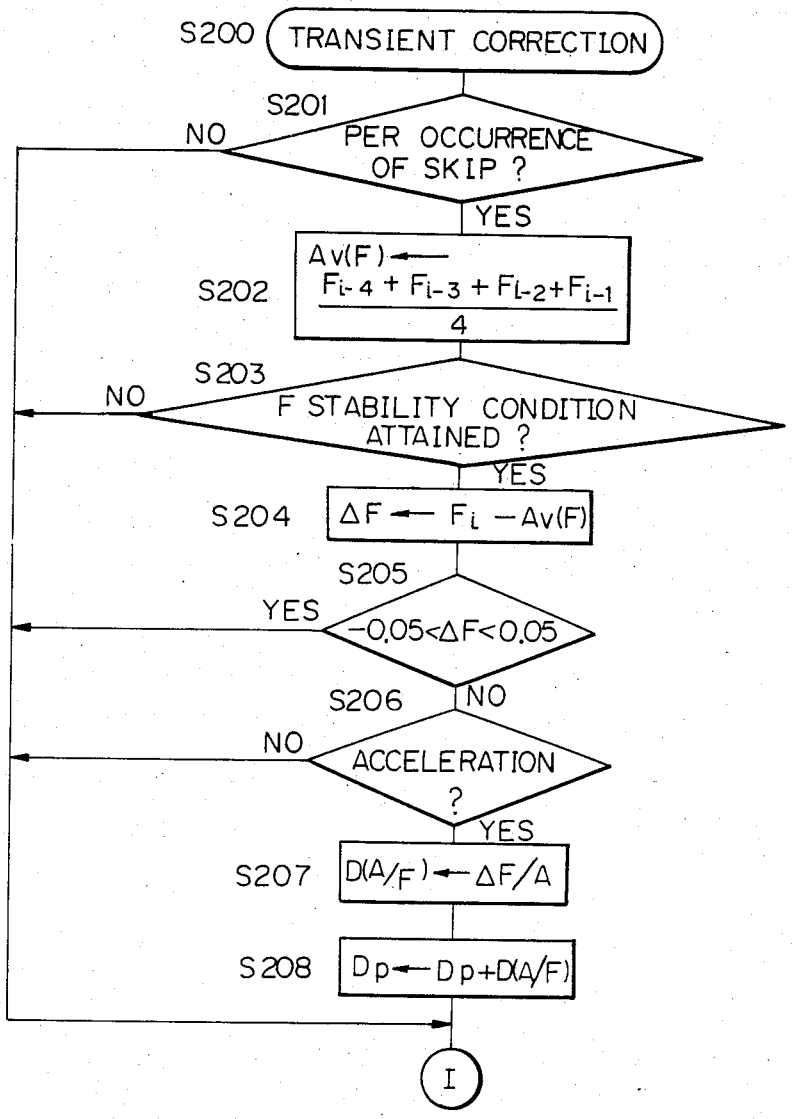
FIG. 9 is a flow chart of the air-fuel ratio variation detection processing in FIG. 8.

FIG. 9 is a detailed flow chart of the air-fuel ratio variation detection processing in the flow shown in FIG. 8. As can be seen from step S201, this processing is performed for each skip of the air-fuel ratio correction signal in the air-fuel ratio feedback control. The value of the signal F immediately before a skip is denoted by $F_n$. In step S202, the average value Av(F) of $F_{i-1}$, $F_{i-2}$, $F_{i-3}$, and $F_{i-4}$ at the four previous skip points where the current $F_n$ is $F_i$ is calculated.

When it is determined in step S203 that the differences between the average value Av(F) and $F_{i-1}$, $F_{i-2}$, $F_{i-3}$, and $F_{i-4}$ are below a critical value $L_f$, it is determined that the signal F is stable. In step S204, a difference ΔF between the average value Av(F) and the current value $F_i$ of the signal F is calculated.

When the absolute value of the difference ΔF exceeds the critical value $L_f$, a lean spike and a rich spike of the air-fuel ratio are generated. It is checked in step S205 if the absolute value of the difference ΔF is within a predetermined range. When it is determined that the absolute value falls outside the predetermined range, it is determined that the lean or rich spike is generated. It is then checked in step S206 if the spike is generated by acceleration. If it is determined that the spike is generated by acceleration, a value D(A/F) obtained by dividing ΔF by an acceleration amount A is calculated in step S207. According to the present invention, the acceleration A is represented by the change in the intake air amount ΔQ/N per rotation of the engine. The value D(A/F) represents the air-fuel ratio variation in the transient state. That is, the value D(A/F) becomes positive in the case of a lean spike and becomes negative in the case of a rich spike. In step S208, the value D(A/F) is added to a transient air-fuel ratio variation correction coefficient $D_p$ to update the correction coefficient $D_p$.

Figure 10:
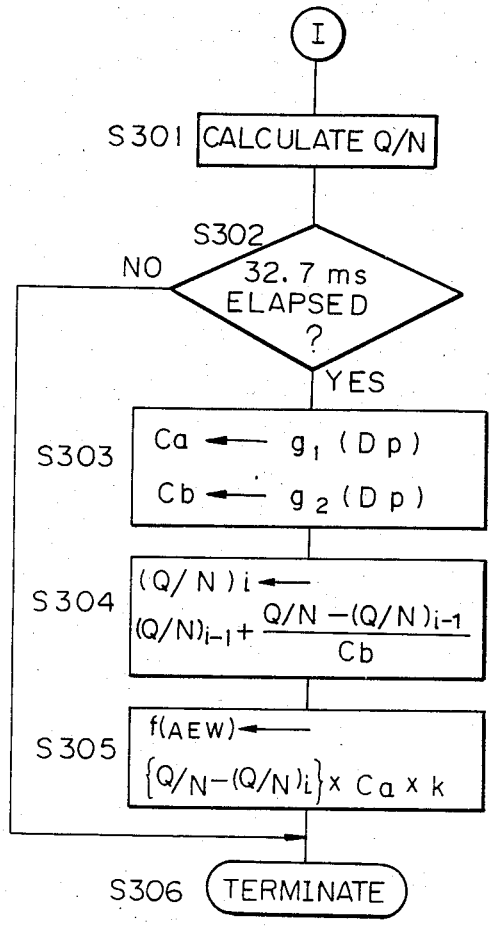
FIG. 10 is a flow chart for calculating a fuel amount correction ratio in a transient state.

FIG. 10 is a flow chart for calculation of a transient fuel amount correction ratio f(AEW). In step S301, the intake air amount Q/N per rotation of the engine is calculated in accordance with the intake air amount signal Q from the intake air amount sensor 2 and the rotational speed signal N from the rotational speed sensor 3. In step S302, discrimination for performing the following processing at predetermined intervals (e.g., every 32.7 ms) is performed.

In step S303, a correction coefficient $C_a$ and a blunting coefficient $C_b$ as functions of the transient air-fuel ratio correction coefficient $D_p$ are calculated. That is, the correction coefficient $C_a$ and the blunting coefficient $C_b$ corresponding to the air-fuel ratio variation D(A/F) during acceleration are calculated.

In step S304, a blunted value $(Q/N)_i$ of the ratio Q/N is calculated in accordance with the following equation:

$$(Q/N)_i=(Q/N)_{i-1}+\{Q/N-(Q/N)_{i-1}\}/Cb$$

where (Q/N) calculated at a time 32.7 ms prior is defined as $(Q/N)_{i-1}$.

In step S305, based on the values of Q/N, $(Q/N)_i$, $C_a$, and a value K determined by the cooling water temperature, the transient fuel correction ratio f(AEW) is calculated in accordance with the following equation:

$$f(AEW)=\{Q/N-(Q/N)_i\}\times C_a\times K$$

where K is a correction ratio for the engine cooling water temperature and is prestored in a map. The value of f(AEW) can be positive or negative depending upon the value of Q/N. The transient fuel correction ratio f(AEW) is multiplied with the fundamental fuel injection amount to correct the ratio.

Figure 11:
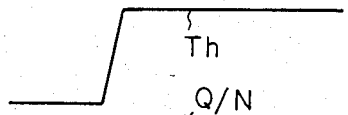
FIGS. 11(1)–11(10) are a waveform chart of waveforms of signals at respective portions of the circuit shown in FIG. 4.
Figure 11:
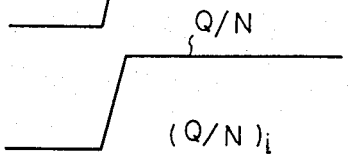
Figure 11:
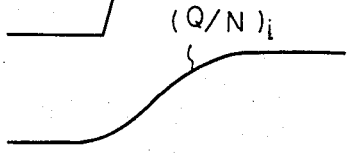
Figure 11:
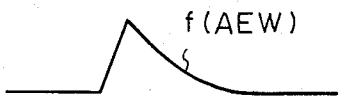
Figure 11:
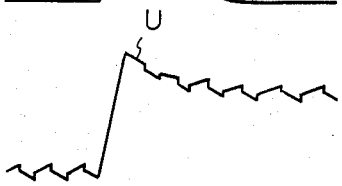
Figure 11:
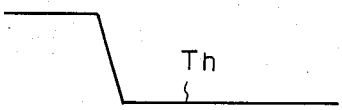
Figure 11:
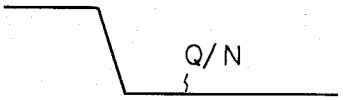
Figure 11:
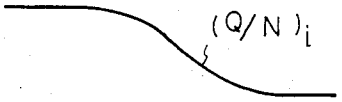
Figure 11:
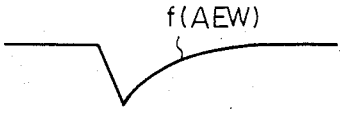
Figure 11:
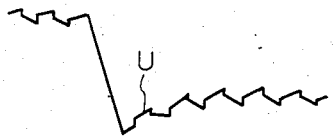

Referring to FIG. 11, (1) when the throttle is opened to accelerate the automobile (where $T_h$ is the throttle opening), (2) the value of Q/N is increased, (3) the value of $(Q/N)_i$ is gradually increased, (4) the transient fuel correction ratio f(AEW) is increased as in the illustrated waveform, and (5) the fuel injection valve open time U is calculated and fuel is injected. When (6) the throttle is closed to decelerate the vehicle, (7) the value of Q/N is decreased, (8) the value of $(Q/N)_i$ is gradually decreased, (9) the transient fuel correction ratio f(AEW) is decreased as in the illustrated waveform, and (10) the fuel injection valve open time U is determined and fuel is injected.

Figure 12:
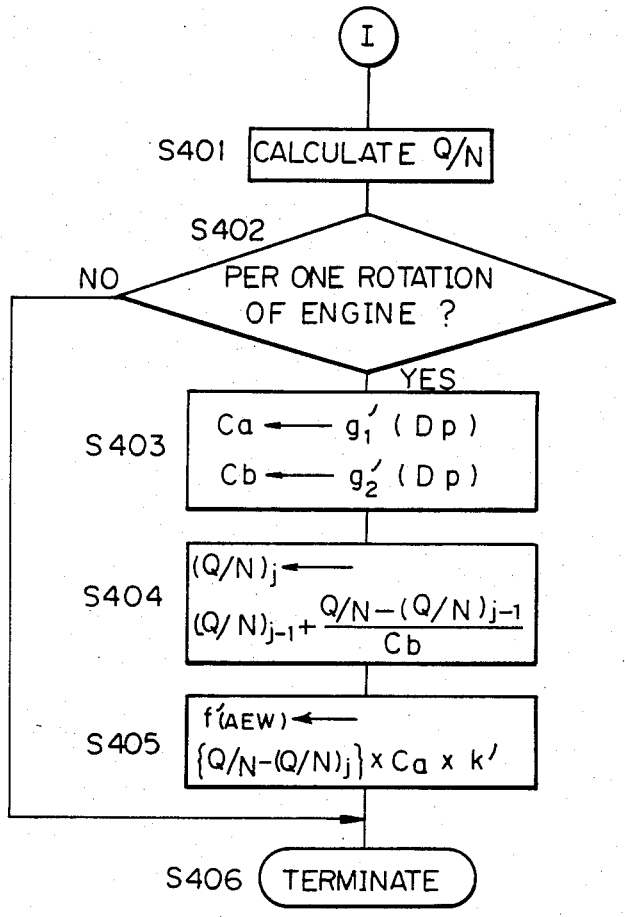
FIG. 12 is a flow chart of another calculation sequence.

In the above embodiment, as shown in step S302, the calculation of $(Q/N)_i$ is performed at predetermined intervals (32.7 ms). However, as shown in the flow chart of FIG. 12, the calculation of $(Q/N)_i$ can be synchronized with the engine rotation and can be performed once per rotation of the engine, for example. Referring to FIG. 12, in step S401, the value of Q/N is calculated. In step S402, it is checked if the engine has rotated once. In step S403, the correction coefficient $C_a$ and the blunting coefficient $C_b$ are calculated as functions of the transient air-fuel ratio correction coefficient $D_p$. In other words, the correction coefficient $C_a$ and the blunting coefficient $C_b$ corresponding to the air-fuel ratio variation D(A/F) during acceleration are calculated.

In step S404, a blunted value $(Q/N)_j$ of the value Q/N is calculated in accordance with the following equation:

$$(Q/N)_j=(Q/N)_{j-1}+\{Q/N-(Q/N)_{j-1}\}/Cb$$

where the value of $(Q/N)_j$ calculated at a time corresponding to one prior rotation of the engine is defined as $(Q/N)_{j-1}$.

In step S405, based on the values of Q/N, $(Q/N)_j$, $C_a$, and K' determined by the cooling water temperature, the transient fuel correction ratio f'(AEW) is calculated in accordance with the following equation:

$$f'(AEW)=\{Q/N-(Q/N)_j\}\times C_a\times K'$$

The value of f'(AEW) is multiplied by the fundamental fuel injection amount to correct the amount.

The value $(Q/N)_j$ is calculated in synchronism with the engine rotation. The number of combustion cycles of the engine contributed by the increase/decrease in the fuel injection amount by the transient air-fuel ratio correction ratio f'(AEW) remains substantially the same under the same accelerating conditions irrespective of the engine rotational speed. Therefore, variations in the air-fuel ratio in a transient state can be prevented in each engine state.

In the above embodiment, the fuel injection amount is increased by using the intake air amount Q/N and its blunted value as factors determining the correction amount. However, this may be performed based on other factors, e.g., the air intake pipe negative pressure, the throttle opening, and its blunted value.

Figure 13:
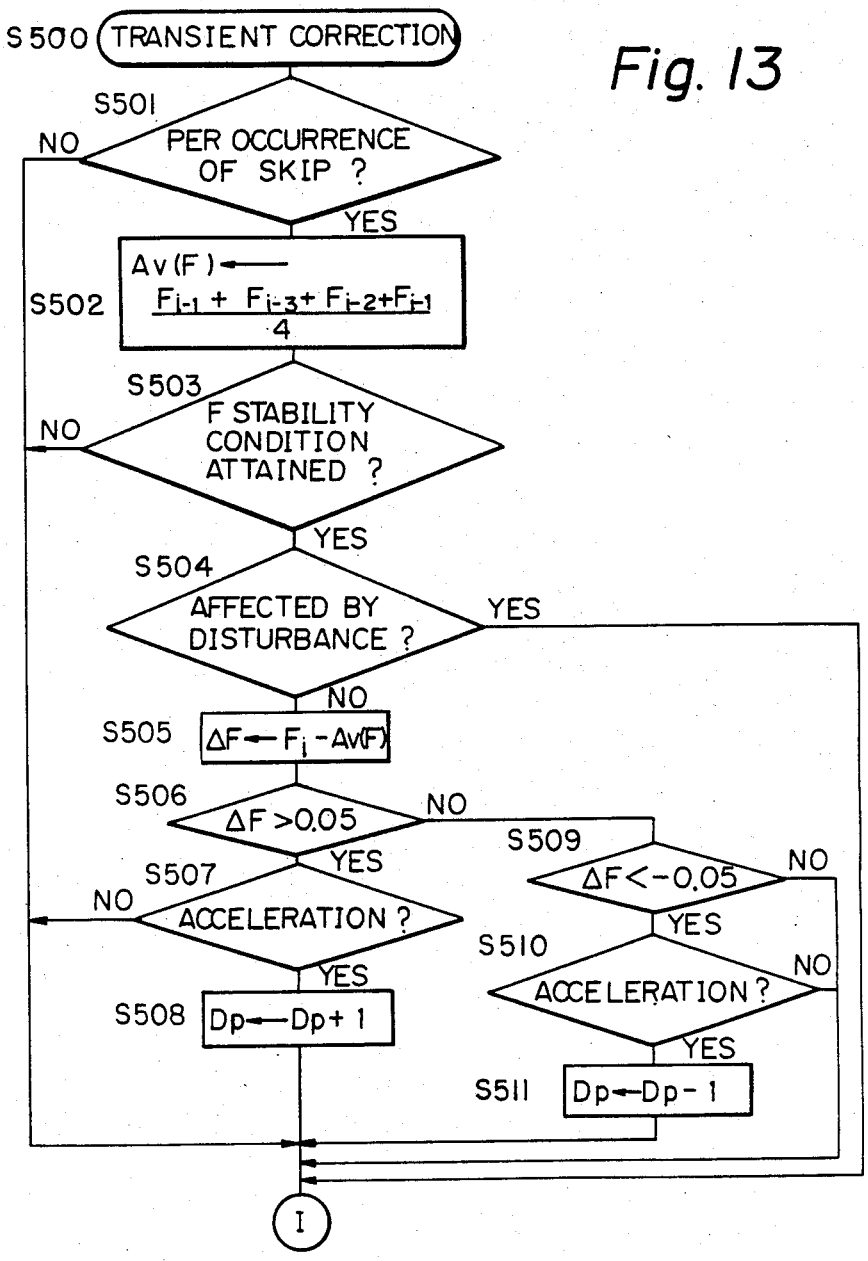
FIG. 13 is a flow chart of a control sequence according to another aspect of the present invention.

As still another aspect of the present invention, a control method considering the influence of flow of a fuel vapor gas into the intake pipe in a purge system is illustrated in FIG. 13.

The processing shown in FIG. 13 is performed at each skip of the air-fuel ratio correction signal F in the air-fuel ratio feedback control, as in step S301. The value of the correction signal F immediately before the skip is defined as $F_n$. In step S502, when the current value $F_n$ is defined by $F_i$, an average value Av(F) of the values $F_{i-1}$, $F_{i-2}$, $F_{i-3}$, and $F_{i-4}$ of the four previous skip points is calculated.

In step S503, when the differences between Av(F) and the values $F_{i-1}$, $F_{i-2}$, $F_{i-3}$, and $F_{i-4}$ are below a predetermined value, it is determined that the signal F is stable. In this case, although the values of the signal F at four consecutive points and Av(F) are used, the number of points need not be 4. In step S504, it is checked if the value of Av(F) falls within a range between 0.95 and 1.05. When the value of Av(F) falls within this range, it is determined that there is no disturbing influence present and the flow advances to step S505. When the value of Av(F) is outside this range, it is determined that there is a disturbing influence and the step advances to step S301, skipping the learning control of steps S505 to S511.

In step S505, a difference ΔF between the value of Av(F) and the current value $F_i$ of the signal F is calculated. When the absolute value of the difference ΔF is larger than a predetermined value, a lean spike or a rich spike of the air-fuel ratio is caused.

In step S506, it is checked if $\Delta F>0.05$. If YES in step S506, it is determined a lean spike has been formed. It is then checked in step S507 if this lean spike had been caused by acceleration. If YES in step S507, the count $D_p$ of the transient air-fuel ratio correction counter is incremented by one.

Similarly, it is checked in step S509 if the inequality $\Delta F<-0.05$ is established. If YES in step S509, it is determined that a rich spike has been formed. In step S510, it is checked if the rich spike has been formed by acceleration. If YES in step S510, the count $D_p$ of the transient air-fuel ratio correction counter is decremented by one. In this manner, the transient air-fuel ratio variation can be indicated by the count $D_p$ of the correction counter. The threshold values of 0.05 and −0.05 for discriminating the lean and rich spikes are not particularly limited to these values.

Figure 14:
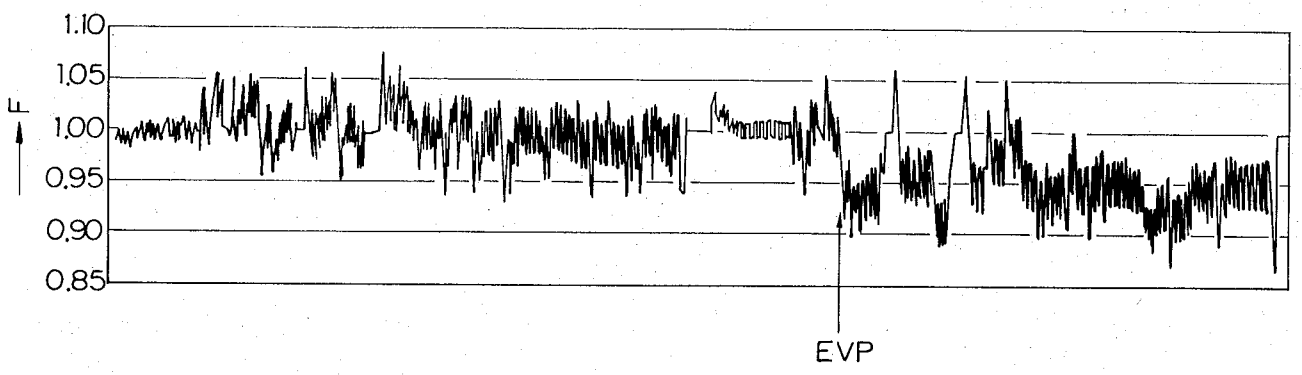
FIG. 14 is a graph of changes in the air-fuel ratio correction signal when a fuel vapor gas flows into an intake pipe by means of a fuel vapor gas exhaust prevention device.

FIG. 14 shows changes in the signal F when a fuel vapor gas flows into the air intake pipe by a purge system. When the fuel vapor gas flows in (EVP), the signal level is lowered. The central level of the signal before the flow of the fuel vapor gas shifts to the vicinity of 1.0, and after the flow shifts to the vicinity of 0.94. Conversely, when air leakage occurs in the air intake system such as in the intake pipe, the level of the signal F shifts upward. When the signal F is influenced by disturbance, the correct value of the transient air-fuel ratio variation cannot be detected from the signal F. Therefore, according to the present invention, when the central level of the signal F in a stable state falls within a range between 0.95 and 1.05, it is determined that no influence of disturbance is present. When the influence of disturbance is detected, learning is prohibited. The values 0.95 and 1.05 as threshold values for determining the presence/absence of influence of disturbance are not limited to these values. With this control procedure, erroneous learning due to the influence of disturbance is prevented.

Various other modifications can also be made according to the present invention.

In step S503 in FIG. 13 for determining the stable state, when a time DT corresponding to from $f_{i-4}$ to $f_{i-1}$ is below a predetermined value, the stable state can be determined.

Figure 15:
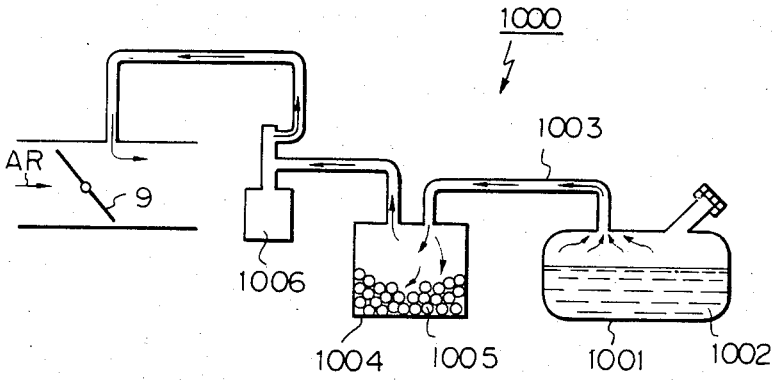
FIG. 15 is a schematic sectional view of the fuel vapor gas exhaust prevention device.

The control procedure as shown in FIG. 13 must be performed for the following reason. FIG. 15 shows a fuel vapor gas prevention device (purge system) 1000 which prevents gasification and exhaust of gasoline from a fuel tank into the outer atmosphere. In a vehicle having such a purge system, the air-fuel ratio A/F changes significantly and correct detection of the air-fuel ratio variation cannot be performed due to the influence of gasoline supplied from the purge system.

The purge system 1000 shown in FIG. 15 has a fuel tank 1001, gasoline 1002, a fuel vapor gas flow 1003, a canister 1004, activated carbon 1005, a control valve 1006, and a throttle 9. Reference symbol AR denotes an air flow.

Figures 16, 16A, 16B, 16C:
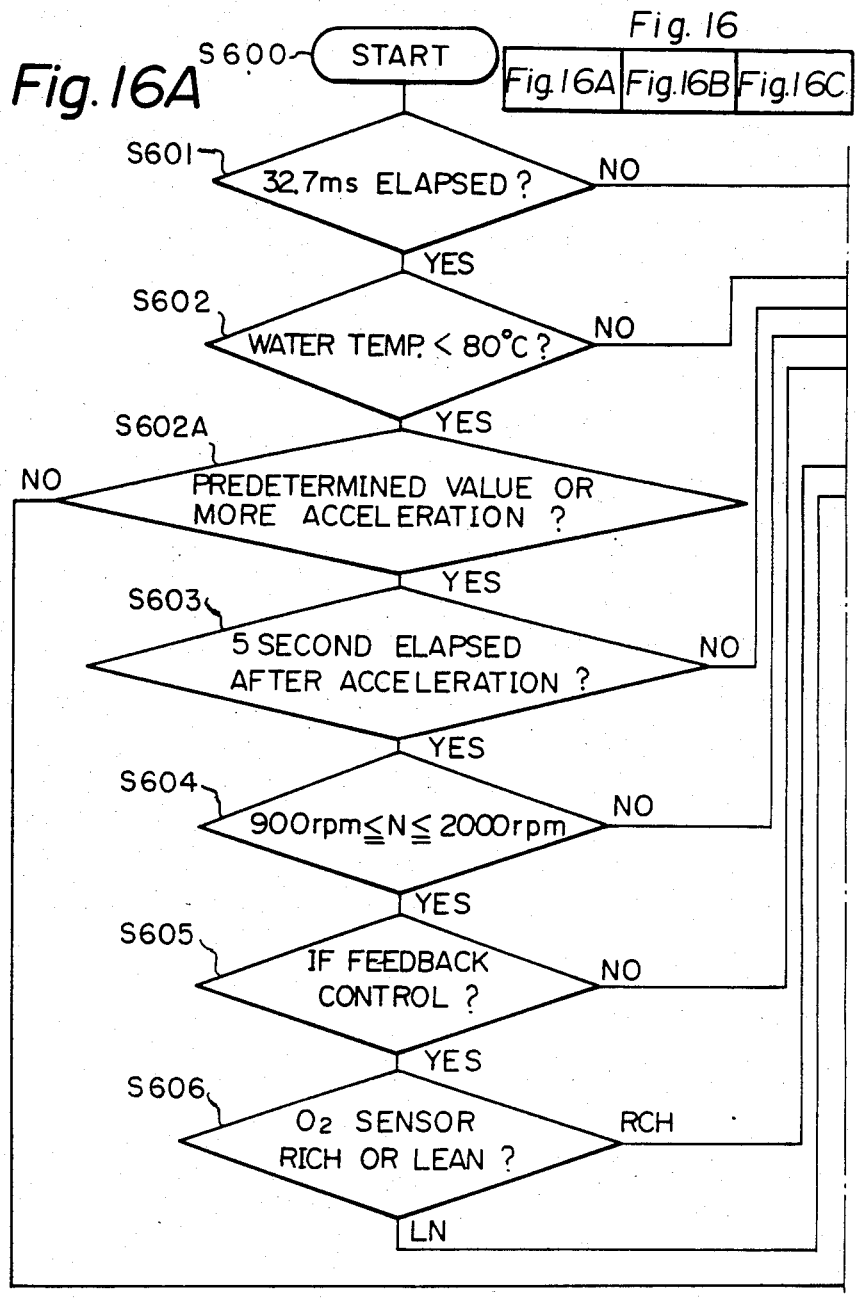
FIGS. 16A,16B and 16C are a flow chart of a control sequence of an embodiment according to another aspect of the present invention.
Figure 16B:
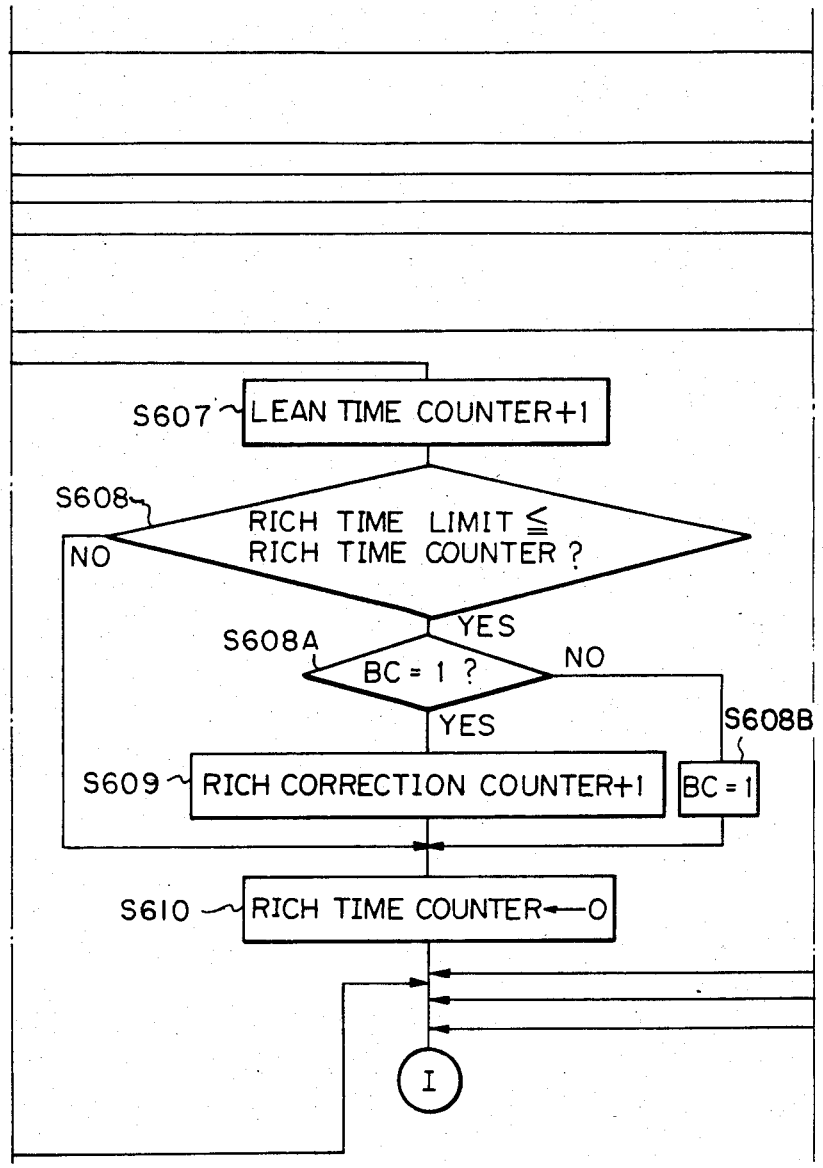
Figure 16C:
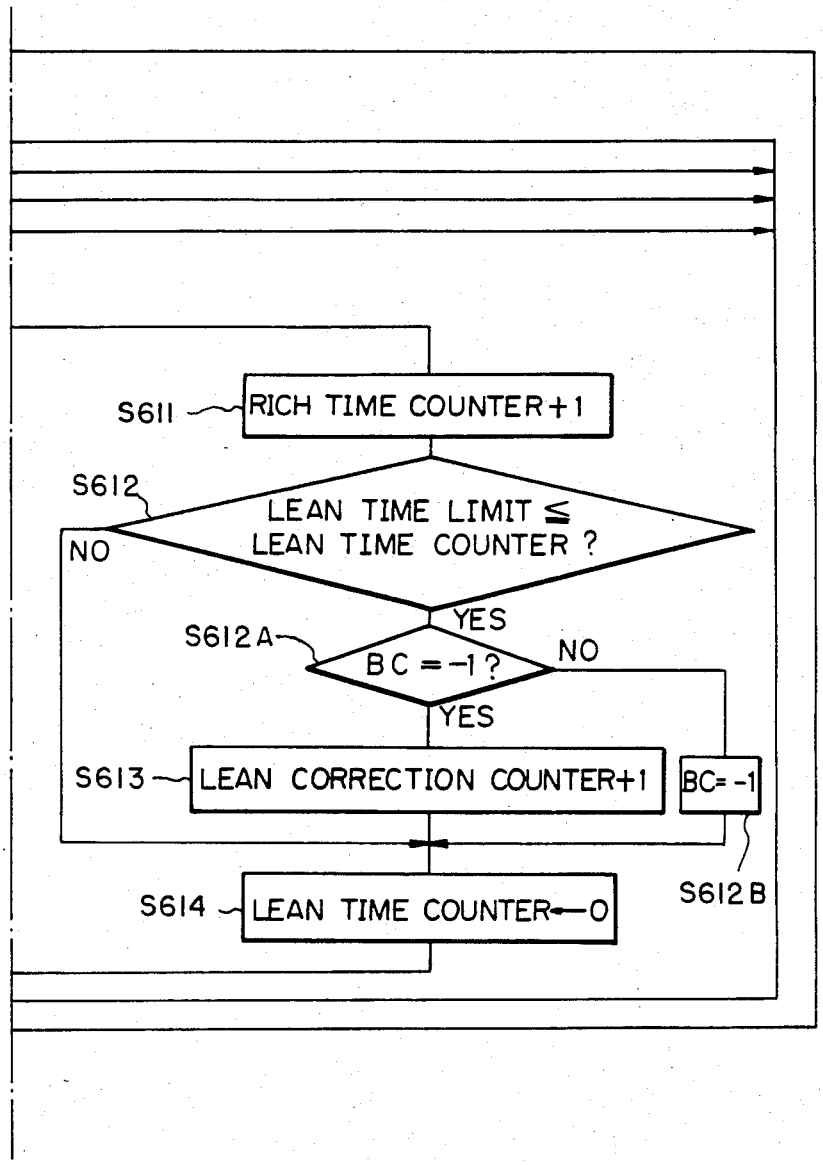

A control method considering an acceleration/deceleration amount in an internal combustion engine according to another aspect of the present invention is shown in FIG. 16. As shown in FIG. 16, processing is performed at predetermined intervals (e.g., 32.7 ms). As a method for detecting the air-fuel ratio variation, a method is adopted wherein an output signal from the air-fuel sensor 6 is compared with a constant voltage level, two states of an air-fuel mixture, a lean state and a rich state, are detected, and a lean time T(LN) and a rich time T(RCH) during acceleration are measured.

For example, the influence of carbon deposits is seen only when the cooling water temperature is low. In order to stably and precisely measure the amount of these deposits, steps S602, S602-A, S603, and S604 are performed. In step S602, it is checked if the cooling water temperature is less than 80° C. In step S602-A, it is checked if the acceleration exceeds a predetermined value. In step S603, it is checked if 5 seconds have elapsed after acceleration. In step S604, it is checked if the engine rotational speed is within a range between 900 and 2,000 rpm, and the lean time T(LN) and the rich time T(RCH) are measured. In step S605, it is checked if the feedback control is being performed, so that the rich and lean states are alternately achieved.

The rich or lean state is discriminated in step S606. If the lean state is determined, the lean time counter is incremented by one and the time T(LN) is measured in units of 32.7 ms in step S607. In step S608, it is checked if the count of the rich time counter exceeds a predetermined value (rich time limit). If the count exceeds the predetermined value, the rich state is determined and the flow advances to step S608-A. When it is determined that BC=1 in step S608-A, the previous discrimination result is a rich state. Therefore, the rich correction counter is incremented by 1 in step S609. When BC≠1 in step S608-A, since the previous discrimination result is not a rich state, the rich correction counter is not updated. In step S608-B, the operation BC=1 is performed, and the flow advances to step S610. In step S610, the rich time counter is reset or cleared to 0. When a rich state is determined in step S610, the incrementing of the rich time counter by one and the discrimination of the lean time are similarly performed in steps S611 to S614, S612-A, and S612-B.

The attachment and separation of a deposit can be determined in accordance with the counts of the lean and rich correction counters which are calculated in steps S606 to S614 described above. Thus, a change from a normal state to an abnormal state of the engine and a return from an abnormal state to a normal state can be determined.

Figure 17:
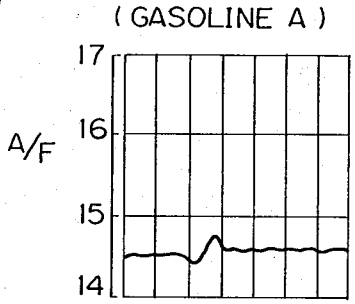
FIGS. 17 and 18 are graphs showing examples of operation results of the embodiment shown in FIG. 16.
Figure 18:
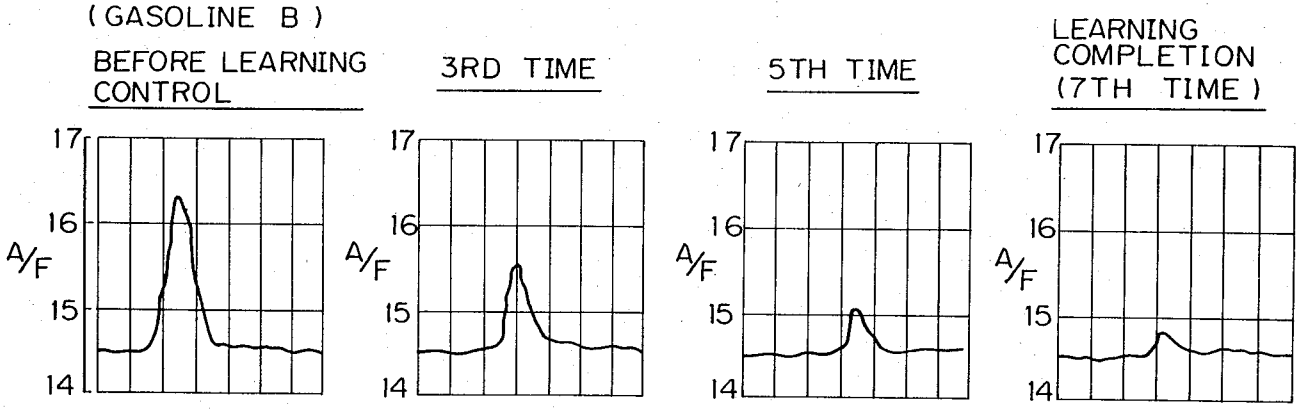

An example of the operation is illustrated in FIGS. 17 and 18. Referring to FIGS. 17 and 18, the engine rotational speed is set at 1,000 rpm, and the cooling water temperature is set to be 30° C. Acceleration is performed by operating the throttle, and the acceleration conditions are an abrupt acceleration from an air intake pressure "−400 mmHg" to "−100 mmHg". FIG. 17 shows the air-fuel ratio as a function of time when gasoline A is used. FIG. 18 shows the air-fuel ratio when gasoline B is used. Each of these figures shows the learning results.

As can be seen from FIGS. 17 and 18, the air-fuel ratio during acceleration is optimum with the gasoline A (10% distillation temperature of 47° C. and lead vapor pressure of 0.72 kg/cm$^2$). However, with the gasoline B having poor volatility (10% distillation temperature of 54° C. and lead vapor pressure of 0.6 kg/cm$^2$), the air-fuel ratio during acceleration becomes lean. When learning is performed, air-fuel ratio characteristics the same as those of gasoline A can be obtained after seven learning control operations. If the correction amount is increased, the number of learning operations can be decreased.

Figure 19:
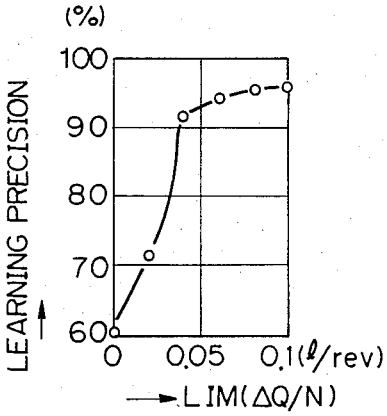
FIG. 19 is a graph showing LIM ($\Delta Q/N$) and the learning precision.
Figure 20:
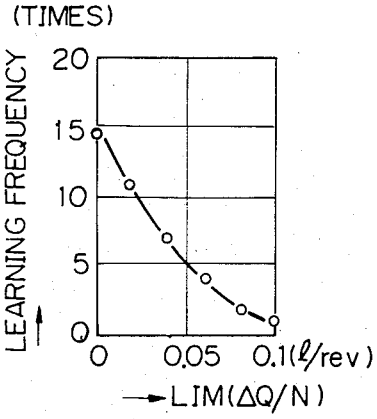
FIG. 20 is a graph showing LIM ($\Delta Q/N$) and the learning frequency.

FIGS. 19 and 20 are graphs showing the relationship between the learning precision and the learning frequency when learning is performed by achieving the running of the first cold cycle of LA No. 4 mode with an acceleration limit LIM(ΔQ/N) in step S602-A as a limiting condition for detecting the air-fuel ratio variation in FIG. 16. The acceleration amount is detected in accordance with the change amount ΔQ/N(l/rev) of the intake air amount, and learning is performed when ΔQ/N≧LIM(ΔQ/N).

Figure 21:
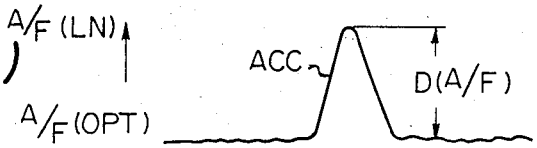
FIGS. 21(1)–21(3) are a waveform chart for explaining the discrimination of an acceleration state.
Figure 21:
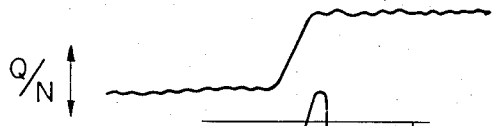
Figure 21:
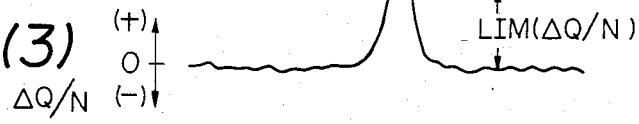

FIGS. 21(1), 21(2) and 21(3) show waveform charts for explaining the descrimination of an accelration state of the engine. When the engine is accelerated, the value of Q/N increases as shown in FIG. 21(2), however, the value of the air-fuel ratio A/F remarkably deviates to the lean side from the optimum air-fuel ratio A/F (OPT) due to the response delay of the system, as shown in FIG. 21(1). Therefore, the discrimination of the acceleration state is detected by checking if a differential value of the value Q/N (i.e., ΔQ/N) exceeds a predetermined acceleration limit value LIM (ΔQ/N), as shown in FIG. 21(3). Thus, when an acceleration state is detected, the deviation of the air-fuel ratio D (A/F) shown in FIG. 21(1) is reduced by carrying out the learning control.

As can be seen from FIGS. 19 and 20, when the limit LIM(ΔQ/N) is set at 0.04, a learning precision of 90% or more is obtained and the learning frequency is stabilized at seven, thereby allowing stable and precise learning. In the present invention, the limit LIM(ΔQ/N) is not limited to 0.04. If the learning precision is given priority, the limit can be set larger than 0.04.

The control process shown in FIG. 17 must be performed for the following reason. When transient air-fuel ratio learning control is performed by the fundamental fuel injection amount correction value F based on the signal from the A/F sensor for detecting the engine exhaust gas components, the transient air-fuel ratio variation D(A/F) must be detected from the range of the change ΔF(RCH) of the air-fuel ratio correction signal and it must be determined if the change has been made during acceleration. In this learning control, if acceleration is determined and learning is performed when the change ΔQ/N of Q/N (intake air amount per rotation of the engine) exceeds a predetermined acceleration limit LIM(ΔQ/N), that is, when ΔQ/N≧LIM(ΔQ/N), the learning precision is improved with an increase in the limit LIM(ΔQ/N) as shown in FIGS. 19 and 20. On the other hand, when the limit LIM(ΔQ/N) is increased, the learning frequency is lowered. Therefore, the limit LIM(ΔQ/N) cannot be increased excessively. When engine trouble due to erroneous learning is considered, acceleration is determined above a predetermined level so as to improve the learning precision. In the learning control, when an excessive increase or decrease ΔQ/N is detected, the learning value can be modified immediately. However, if the same determination result is obtained n (where n≧2) consecutive times, the learning value can be changed. In this case, the learning value is not changed inadvertently by erroneous discrimination and a significant improvement in control precision can be expected.

We claim:

1. A method for controlling the air-fuel ratio in an internal combustion engine using operating condition sensing means for sensing a parameter corresponding to a load of the engine and the air-fuel ratio of the engine, injection valve means driven by electrical signal to carry out injection of fuel, and control means for receiving signals from said operating condition sensing means and producing the electrical signals for driving said injection valve means, said method comprising the steps of:

obtaining an air-fuel ratio variation (D (A/F)) with respect to an optimum air-fuel ratio, obtaining a blunting coefficient Cb on the basis of said obtained air-fuel ratio variation (D (A/F)), obtaining a blunted value of said parameter corresponding to a load of the engine on the basis of said obtained blunting coefficient Cb, and regulating a transient fuel amount correction ratio (f (AEW)) on the basis of the difference between the current value and said blunted value of said parameter.

2. A method according to claim 1, wherein said transient fuel amount correction decides a correction value at a predetermined time interval.

3. A method according to claim 1, wherein said transient fuel amount correction decides a correction value in synchronization with the rotation of the engine.

4. A method according to claim 1, wherein said air-fuel ratio variation is caused by deposits builtup in an air intake system in the engine.

5. A method according to claim 1, wherein said air-fuel ratio variation is caused by deposits builtup in a nozzle of an injector for supplying fuel to the engine.

6. A method according to claim 1, wherein said air-fuel ratio variation is caused by variations between manufactured structures of intake air amount sensing means in engines or by changes with time in operating characteristics of intake air amount sensing means in the engines.

7. A method according to claim 1, wherein said air-fuel ratio variation is caused by variations between manufactured structures of engines or by changes with time in operating characteristics of the engine.

8. A method according to claim 1, wherein said air-fuel ratio variation is obtained on the basis of a ratio between a variation amount (ΔF) of an air-fuel ratio correction signal (F) and an acceleration amount in air-fuel ratio feed-back control using the air-fuel ratio sensing means.

9. A method according to claim 1, wherein said transient fuel amount correction ratio is regulated on the basis of the difference between said current value and said blunted value of said parameter and the correction coefficient Ca obtained on the basis of said air-fuel ratio variation (D (A/F)).

10. A method according to claim 1, wherein said parameter corresponding to a load of the engine is determined from the intake air amount of the engine and the engine rotational speed.

11. A method according to claim 1, wherein said parameter corresponding to a load of the engine is determined from an opening degree of a throttle valve of the engine.

12. A method according to claim 1, wherein said parameter corresponding to a load of the engine is determined from a pressure in an air intake pipe of the engine.

13. A method according to claim 1, wherein said air-fuel ratio variation is caused by variation between properties of fuels and used in the engine.

14. A method for controlling the air-fuel ratio in an internal combustion engine using operating condition sensing means for sensing the intake air amount, the engine rotational speed and the air-fuel ratio of the engine, injection valve means driven by an electrical signal to carry out injection of fuel, and control means for receiving signals from said operating condition sensing means and producing the electrical signal for driving said injection valve means, said method comprising the steps of:

prohibiting regulation of the correction amount in transient fuel amount correction when no correct detection of air-fuel ratio variation is achieved because of a disturbance in the engine condition;

obtaining values corresponding to an air-fuel ratio variation with respect to an optimum air-fuel ratio in the engine where no disturbing influence is exerted on the engine condition; and regulating a correction amount of the transient fuel amount correction on the basis of said obtained values corresponding to the air-fuel ratio variation.

15. A method according to claim 14, wherein said disturbance is caused by an entry of fuel evaporation gas into an air intake pipe of the engine having a purge system.

16. A method according to claim 14, wherein said disturbance is caused by leakage of air in an air intake system of the engine.

17. A method for controlling the air-fuel ratio in an internal combustion engine using operation condition sensing means for sensing the intake air amount, the engine rotational speed, and the air-fuel ratio of the engine, injection valve means driven by an electrical signal to carry out injection of fuel, and control means for receiving signals from said operating condition sensing means and producing the electrical signal for driving said injection valve means, said methods comprising the steps of:

detecting an air-fuel ratio variation with respect to an optimum air-fuel ratio as a valid air-fuel ratio variation when an acceleration/deceleration amount of the engine exceeds a predetermined threshold value, while detecting an air-fuel ratio variation with respect to the optimum air-fuel ratio as an invalid air-fuel ratio variation when the acceleration/deceleration amount of the engine is below the predetermined threshold value; and regulating the correction amount of the transient fuel amount correction on the basis of said air-fuel ratio variation detected as a valid air-fuel ratio variation.

18. A method according to claim 17, wherein said air-fuel ratio variation is caused by the variation between properties of fuels and used in the engine.

* * * * *